US007189021B1

(12) United States Patent
Gordon

(10) Patent No.: US 7,189,021 B1
(45) Date of Patent: Mar. 13, 2007

(54) WRITING OR MARKING INSTRUMENT WITH ATTACHED STAPLER

(75) Inventor: Eduardo Gordon, Hollis Hills, NY (US)

(73) Assignee: Q Marketing, Ltd., Great Neck, NY (US)

( * ) Notice: Subject to any disclaimer, the term of this patent is extended or adjusted under 35 U.S.C. 154(b) by 0 days.

(21) Appl. No.: 11/237,240

(22) Filed: Sep. 28, 2005

(51) Int. Cl.
*B43K 29/00* (2006.01)

(52) U.S. Cl. ..... 401/195

(58) Field of Classification Search ..... 401/52, 401/195
See application file for complete search history.

(56) References Cited

U.S. PATENT DOCUMENTS 2,295,603 A * 9/1942 Purchard ..... 401/52
5,114,257 A * 5/1992 Hsu ..... 401/195

* cited by examiner

*Primary Examiner*—Tuan Nguyen
(74) *Attorney, Agent, or Firm*—R. Neil Sudol; Henry D. Coleman; William J. Sapone

(57) ABSTRACT

A pen and stapler combination has a stapler body pivotably mounted to pen casing. A cover is movably attached to the stapler body for preventing the stapling of a pocket when the stapler body is used as a clip to attach the pen to a pocket.

14 Claims, 2 Drawing Sheets

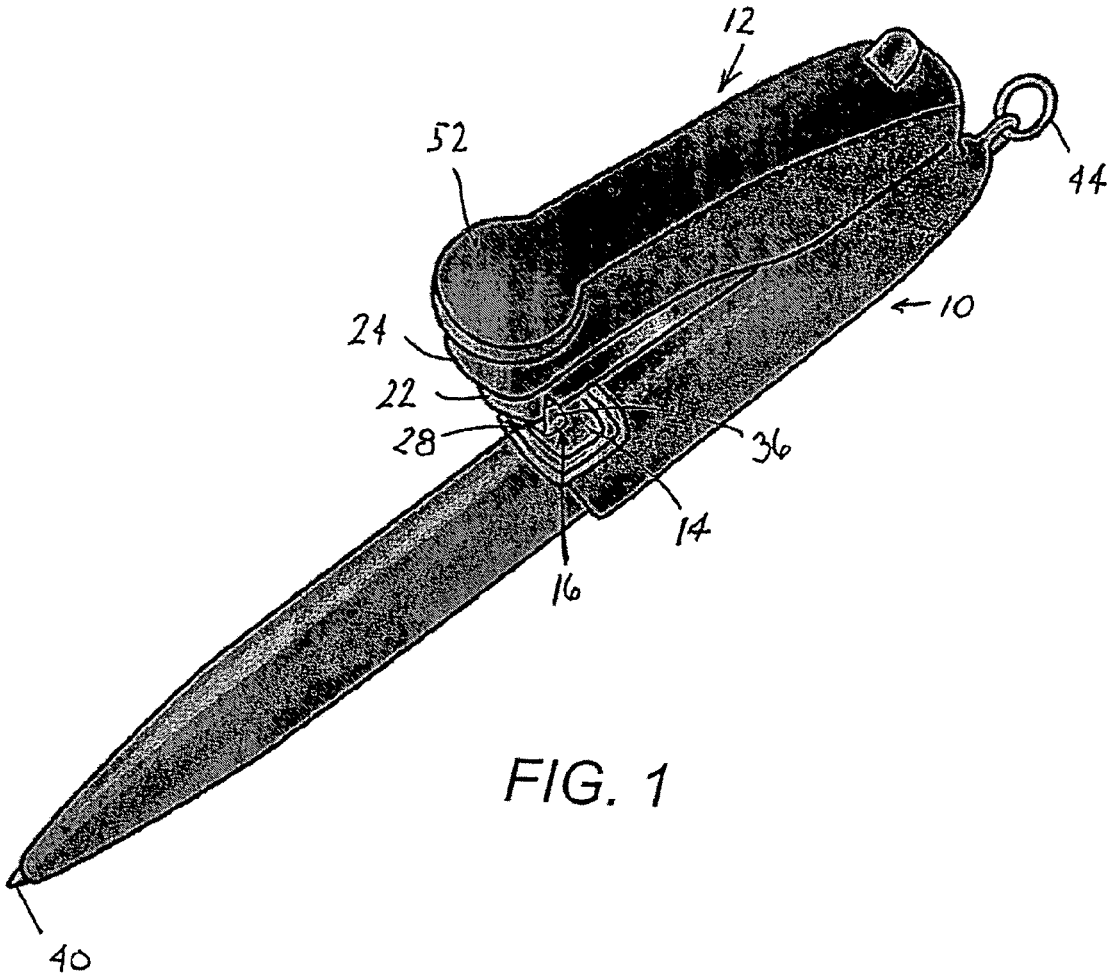
FIG. 1
FIG. 5
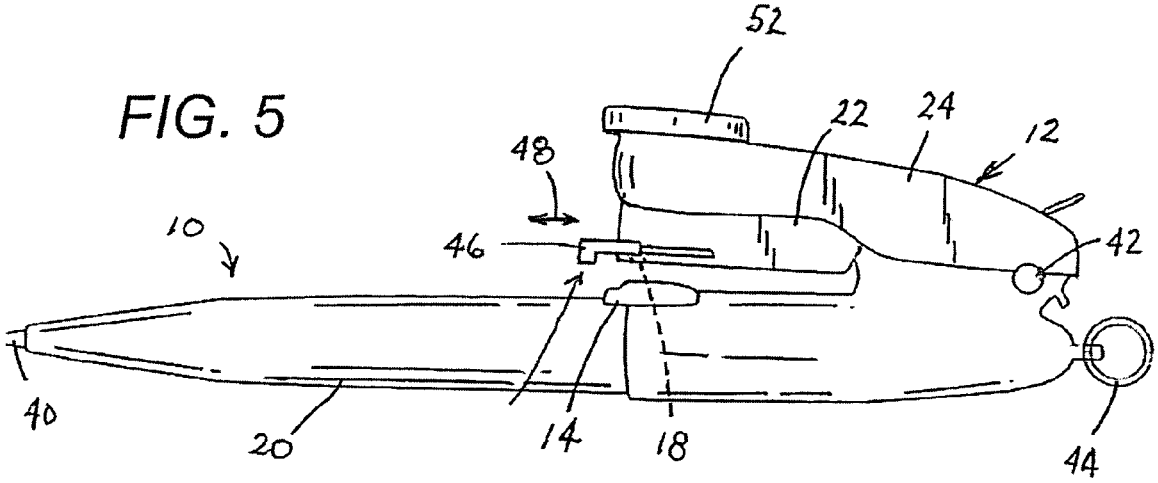

WRITING OR MARKING INSTRUMENT WITH ATTACHED STAPLER

BACKGROUND OF THE INVENTION

This invention pertains to writing or marking tools. More particularly, this invention pertains to an instrument with combined writing and stapling functionality.

In the world of trade shows, buyers typically walk around a convention floor with a pen in one hand and a pad in another and then are always fumbling around with a miniature stapler. The stapler is used to affix suppliers' business cards to the buyer's notes. Either the stapler or the pen is frequently left behind. This creates a significant inconvenience for buyers.

OBJECTS OF THE INVENTION

An object of the present invention is to provide a device or instrument that alleviates the afore-described problems.

A more particular object of the present invention is to provide an improved writing or marking implement that includes a stapling component.

Another object of the present invention is to provide such an implement or tool that is convenient to use at trade shows.

An associated object of the present invention is to provide a new and novel method of conducting business at trade shows, where marking and stapling are included steps or actions.

These and other objects of the present invention will be apparent from the drawings and descriptions herein. Although it is believed that every object of the invention is attained in at least one embodiment of the invention, there is not necessarily any single embodiment that achieves all of the objects of the invention.

SUMMARY OF THE INVENTION

A writing or marking implement in accordance with the present invention comprises a pen, a stapler body mounted to the pen, a staple-bending anvil element, and a cover. Either the pen or the stapler body is provided with a staple exit aperture, while the staple-bending anvil element is attached to the other of the pen and the stapler body in alignment with the staple exit aperture. The cover is movably mounted to whichever of the pen and the stapler body that is provided with the staple exit aperture. The cover serves to temporarily block the staple exit aperture and prevent an inadvertent stapling operation.

In a preferred embodiment of the invention, the cover is pivotably mounted to the part that has the staple exit aperture. The part with the staple exit aperture holds a staple magazine and is provided with an ejection mechanism, e.g., a hammer element, for forcing a staple from the magazine through the staple exit opening against the anvil element. The cover alternately swings between a neutral storage position removed from the staple exit aperture and an active staple blocking position aligned with the staple exit aperture.

Preferably, it is the stapler body, and not the pen, that contains the staple magazine and carries the hammer or staple ejector. The pen has a casing that carries the anvil element on an external surface and houses marking components such as an ink reservoir.

Where the staple exit aperture is an elongate slot, the cover may include an elongate plate element extending generally parallel to the staple exit aperture. The cover may further include a pair of ears at opposite ends of the plate element, the cover being coupled to the stapler body (or, alternatively, the pen casing) via the ears for rotation about an axis parallel to the staple exit aperture.

The pen typically has an ink application end, the stapler body being pivotably mounted to the pen at an end opposite the ink application end. That same end of the instrument may be provided with a ring for receiving a lanyard.

In an alternative embodiment of the present invention, the cover is slidably mounted to the part that carries the staple magazine and the ejector (as well as the staple exit aperture). This sliding cover alternately translates between a neutral storage position spaced from the staple exit aperture and an active staple blocking position aligned with and blocking the staple exit aperture.

A method in accordance with the present invention utilizes a writing implement in the form of a pen having a stapler body mounted thereto. The method comprises using the pen to write, using the stapler body and the pen to staple, and thereafter moving a cover over a staple exit aperture to temporarily block the staple exit aperture. A web or sheet is then slid between the stapler body and the pen, with the cover serving to prevent a stapling of the web or sheet.

It is contemplated that the web or sheet is a piece of fabric of an article of clothing, particularly a pocket element. In that case, the sliding of the web or sheet between the stapler body and the pen comprises inserting the pen into a pocket and clipping the pen to the pocket by the stapler body.

Pursuant to a feature of the present invention, the moving of the cover over the staple exit aperture includes pivoting the cover about an axis to swing the cover from a neutral storage position to an active staple blocking position. Alternatively, the moving of the cover over the staple exit aperture includes sliding the cover from a neutral storage position to an active staple blocking position.

Pursuant to another feature of the present invention, the pen and the stapler body are suspended via a lanyard inserted through a ring on one of the pen and the stapler body.

A writing or marking implement in accordance with the present invention is of great interest to trade shows and conventions, as a give away. The thumb portion of the stapler may be imprinted with a name or logo, such as the trade show organizer's name or the name of a trade show participant.

BRIEF DESCRIPTION OF THE DRAWING

FIG. 1 is a schematic perspective view of a marking implement with an attached stapler in accordance with the present invention.

FIG. 5 is a schematic side elevational view showing a modification of the marking pen and stapler of FIGS. 1–4.

DEFINITIONS

The word "pen" is used herein to denote any marking instrument including, but not limited to, a ball point pen, a felt tip pen, a fountain pen, a pencil, a marker, a crayon, and a laser pointer. The "pen casing" is an outer shell that contains the marking components (ink reservoir, graphite stick, laser source) of the pen. The casing may be a unitary component or may comprise two or more parts, such as a pen body and a cap. In the latter case, the stapler may be mounted to the pen body or to the cap.

The term "stapler body" is used generally herein to denote either of two stapler parts connected to one another at a pivot axis. The other part is a pen casing. In a typical embodiment of the present invention, the stapler body includes a staple magazine compartment, a staple exit aperture, and a staple ejector member that is manually operable to force a staple from an end of the magazine through the exit aperture and against an anvil on the other stapler part (the pen casing). However, it is also possible, within the scope of the present invention, for the stapler body to be the anvil-bearing member of the stapler. In that event, the pen casing contains the staple magazine and is provided with a staple exit aperture and the ejector mechanism.

DETAILED DESCRIPTION OF THE PREFERRED EMBODIMENTS

Figure 2:
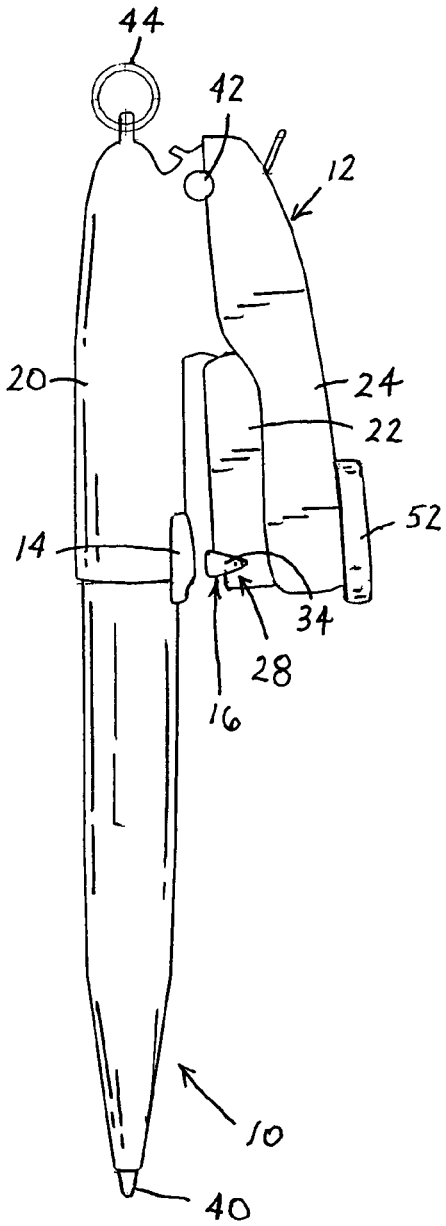
FIG. 2 is a schematic side elevational view of the marking pen and stapler of FIG. 1.
Figure 3:
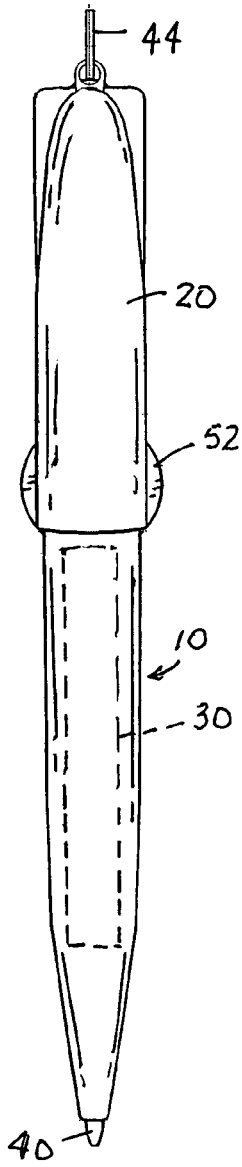
FIG. 3 is a schematic rear elevational view of the marking pen and stapler of FIGS. 1 and 2.
Figure 4:
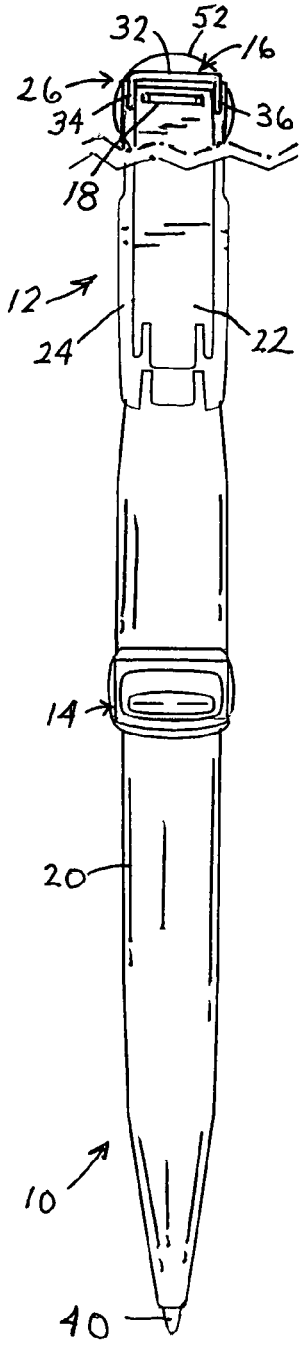
FIG. 4 is a schematic front elevational view of the marking pen and stapler of FIGS. 1–3, showing a stapler magazine part in an open position to reveal a staple-bending anvil on a pen casing.

As depicted in FIGS. 1–4, a writing or marking implement comprises a pen 10, a stapler body 12 mounted to the pen, a staple-bending anvil element 14, and a cover element 16. Stapler body 12 is provided with a staple exit aperture 18 (FIG. 4), while staple-bending anvil element 14 is attached to a casing 20 of pen 10 in alignment with staple exit aperture 18 when stapler body is disposed in a stapling configuration relative to pen casing 20 (FIGS. 1–3). Cover 16 is movably mounted to stapler body 12 in a region about staple exit aperture 18. Cover 16 serves to temporarily block staple exit aperture 18 and prevent an inadvertent stapling operation.

Cover 16 is pivotably mounted to stapler body 12. Stapler body 12 holds a staple magazine in a cartridge-containing part 22 and includes an ejection part 24 that is movably mounted to the cartridge part. Ejection part 24 acts as a hammer mechanism under a manually applied external force to eject a staple (not shown) from the magazine in part 22 through staple exit opening 18 against anvil element 14. Cover 16 alternately swings between a neutral storage position 26 (FIG. 4) removed from staple exit aperture 18 and an active staple blocking position 28 (FIGS. 1 and 2) aligned with the staple exit aperture. In the staple blocking position 28, cover 16 prevents an inadvertent or accidental ejection of a staple. This feature is particularly beneficial where stapler body 12 is used as a clip to hold pen 10 (and stapler body 12) in a pocket. The pocket flap to which the pen is clipped is protected from being stapled.

Pen casing 20 carries anvil element 14 on an external surface and houses marking components such as an ink reservoir 30 (FIG. 3).

Staple exit aperture 18 is an elongate slot, and cover 16 concomitantly includes an elongate plate element 32 extending generally parallel to the staple exit aperture. Cover 16 further includes a pair of ears 34 and 36 at opposite ends of plate element 32 for coupling the cover to stapler body 12 and more particularly to cartridge-containing part 22 for rotation about an axis parallel to staple exit aperture 18.

Pen 10 includes an ink applicator 40 such as a ball or felt tip at one end. At an opposite end, pen casing 20 is swingably connected to stapler body 12 via a pivot pin 42. That same end of pen casing 20 is provided with a ring 44 for receiving a lanyard (not shown). The lanyard enables the marking and stapling implement to be carried about the neck of the user. Alternatively, the lanyard may be used to couple the implement to an article of clothing via a button hole or a belt.

FIG. 5 illustrates an alternative embodiment with a cover 46 slidably mounted to cartridge-containing part 22 of stapler body 12. Cover 46 is alternately translatable, as indicated by a double-headed arrow 48, between a neutral storage position 50 spaced from staple exit aperture 18 and an active staple blocking position aligned with and blocking the staple exit aperture.

A person using pen 10 to write or mark items such as leaves of paper (not shown) and uses stapler body 12 together with pen casing 20 to staple the leaves of paper to one another. During this stapling operation, cover 16 or 46 is disposed in neutral storage position 26 or 50 spaced from staple exit opening 18. Thereafter cover 16 or 46 is shifted over staple exit aperture 18 to temporarily block the aperture. In the event that a web or sheet such as a piece of pocket fabric is then slid between stapler body 12 and pen casing 20, cover 16 or 46 serves to prevent a stapling of the web or sheet.

As indicated above, the moving of cover 16 over staple exit aperture 18 includes pivoting the cover about axis 38 to swing the cover from neutral storage position 26 to active staple blocking position 28. In contrast, the moving of cover 46 over staple exit aperture 18 includes sliding that cover from neutral storage position 50 to an active staple blocking position located in alignment with staple exit aperture 18 and anvil 14.

Stapler body 12, and more particularly hammer or ejector element 24, includes a thumb-engaging enlargement 52. That enlargement may be imprinted on an upper surface with a name or logo or other identification indicia.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A writing or marking implement comprising:

a pen;

a stapler body mounted to said pen, one of said pen and said stapler body being provided with a staple exit aperture;

a staple-bending anvil element attached to the other of said pen and said stapler body in alignment with said staple exit aperture; and a cover movably mounted to said one of said pen and said stapler body for temporarily blocking said staple exit aperture, said cover serving to prevent a stapling of a web or sheet.

2. The implement defined in claim 1 wherein said cover is pivotably mounted to said one of said pen and said stapler body for alternately swinging between a neutral storage position and an active staple blocking position.

3. The implement defined in claim 2 wherein said staple exit aperture is elongate, said cover including an elongate plate element extending generally parallel to said staple exit aperture, said cover further including a pair of ears at opposite ends of said plate element, said cover being coupled to said one of said pen and said stapler body via said ears for rotation about an axis parallel to said staple exit aperture.

4. The implement defined in claim 3 wherein said pen has an ink application end and an opposite end, said stapler body being pivotably mounted to said pen at said opposite end.

5. The implement defined in claim 4 wherein one of said pen and said stapler body is provided at said opposite end with a ring for receiving a lanyard.

6. The implement defined in claim 1 wherein said cover is slidably mounted to said one of said pen and said stapler body for alternately translating between a neutral storage position and an active staple blocking position.

7. The implement defined in claim 1 wherein said pen has an ink application end and an opposite end, said stapler body being pivotably mounted to said pen at said opposite end.

8. The implement defined in claim 1 wherein said pen has an ink application end and an opposite end, one of said pen and said stapler body being provided at said opposite end with a ring for receiving a lanyard.

9. A method comprising:

providing a writing implement in the form of a pen having a stapler body mounted thereto;

using said pen to write;

using said stapler body and said pen to staple;

thereafter moving a cover over a staple exit aperture to temporarily block said staple exit aperture; and sliding a web or sheet between said stapler body and said pen, said cover serving to prevent a stapling of said web or sheet.

10. The method defined in claim 9 wherein said web or sheet is a piece of fabric of an article of clothing.

11. The method defined in claim 10 wherein said piece of fabric is a pocket element, the sliding of said web or sheet between said stapler body and said pen comprising inserting said pen into a pocket and clipping said pen to said stapler body.

12. The method defined in claim 9 wherein the moving of said cover over said staple exit aperture includes pivoting said cover about an axis to swing said cover from a neutral storage position to an active staple blocking position.

13. The method defined in claim 9, further comprising suspending said pen and said stapler body via a lanyard inserted through a ring on one of said pen and said stapler body.

14. The method defined in claim 9 wherein the moving of said cover over said staple exit aperture includes sliding said cover from a neutral storage position to an active staple blocking position.

* * * * *